US008101923B2

(12) United States Patent
Orlando et al.

(10) Patent No.: US 8,101,923 B2
(45) Date of Patent: Jan. 24, 2012

(54) SYSTEM AND METHOD FOR SPATIALLY-RESOLVED CHEMICAL ANALYSIS USING MICROPLASMA DESORPTION AND IONIZATION OF A SAMPLE

(75) Inventors: Thomas Michael Orlando, Atlanta, GA (US); Joshua Milbourne Symonds, Maplewood, NJ (US)

(73) Assignee: Georgia Tech Research Corporation, Atlanta, GA (US)

( * ) Notice: Subject to any disclaimer, the term of this patent is extended or adjusted under 35 U.S.C. 154(b) by 385 days.

(21) Appl. No.: 12/269,825

(22) Filed: Nov. 12, 2008

(65) Prior Publication Data

US 2009/0121127 A1 May 14, 2009

Related U.S. Application Data

(60) Provisional application No. 60/987,162, filed on Nov. 12, 2007, provisional application No. 61/107,886, filed on Oct. 23, 2008.

(51) Int. Cl.
*H01J 17/00* (2006.01)
*H01J 17/49* (2006.01)

(52) U.S. Cl. ..... 250/423 R; 250/423 F; 250/424; 250/425; 250/281; 250/282

(58) Field of Classification Search ..... 250/423 F, 250/423 R, 424, 425, 281, 282, 288
See application file for complete search history.

(56) References Cited

U.S. PATENT DOCUMENTS 6,346,770 B1 * 2/2002 Schoenbach et al. ..... 313/491
6,433,480 B1 * 8/2002 Stark et al. ..... 313/631
6,624,583 B1 * 9/2003 Coll et al. ..... 315/111.71
6,703,784 B2 * 3/2004 Vonallmen ..... 315/111.71
6,762,407 B2 * 7/2004 Kalinitchenko ..... 250/294
6,818,193 B2 * 11/2004 Christodoulatos et al. ... 423/210
6,867,548 B2 3/2005 Eden et al.
7,123,361 B1 * 10/2006 Doughty ..... 356/316
7,482,750 B2 * 1/2009 Eden et al. ..... 313/582
7,709,814 B2 * 5/2010 Waldfried et al. ..... 250/492.2
2007/0108910 A1 5/2007 Eden et al.

OTHER PUBLICATIONS

Miclea, Manuela; Kunze, Kerstin; Franzke, Joachim; and Niemax, Kay; "Microplasma Jet Mass Spectrometry of Halogenated Organic Compounds;" J. Anal. At. Spectrom.; 2004; 19; pp. 990-994.

* cited by examiner

*Primary Examiner* — David A Vanore

(74) *Attorney, Agent, or Firm* — Ryan A. Schneider, Esq.; Troutman Sanders LLP

(57) ABSTRACT

A method and system for desorbing and ionizing molecules from a sample for mass spectrometry using a microplasma device is disclosed. The system and method relies upon a microplasma device, or array of such devices, to partially ionize a gas to form a microplasma. The ionized gas can be a mixture of a noble gas, such as neon or argon, and hydrogen ($H_2$). The ionized gas can form a effluent stream directed onto the surface of a sample to desorb molecules from the remainder of the sample. The desorbed molecules can be ionized by the effluent stream as they leave the surface of the sample. The ionization process can include: photoionization, penning ionization, chemical ionization (proton transfer), and electron impact ionization. The ionized particles from the sample can be directed to a mass spectrometer for analysis. This can produce spatially-resolved mass spectral data, and can be conducted concurrently with another imaging system, such as a microscope.

30 Claims, 14 Drawing Sheets

SYSTEM AND METHOD FOR SPATIALLY-RESOLVED CHEMICAL ANALYSIS USING MICROPLASMA DESORPTION AND IONIZATION OF A SAMPLE

CROSS REFERENCE TO RELATED APPLICATIONS

This application claims benefit under 35 U.S.C. §119(e) of U.S. Provisional Patent Application Ser. No. 60/987,162, filed 12 Nov. 2007, and 61/107,886, filed 23 Oct. 2008, both of which applications are hereby incorporated by reference.

BACKGROUND OF THE INVENTION

1. Field of the Invention

The present invention relates generally to microplasma-assisted desorption and ionization. In particular, the invention relates to a microplasma device serving as an ion source for a mass spectrometer.

2. Description of Related Art

Mass spectrometry is an analytical technique that identifies the chemical composition of a compound or sample based on the mass-to-charge ratio of charged particles. The technique requires a portion of the sample to be chemically fragmented and the fragmented segments to be ionized into charged particles. These particles are then passed into any type of mass spectrometer, which will determine their mass-to-charge ratio.

Three of the most common categories of mass spectrometers are known as time-of-flight mass analyzers, quadrupole mass analyzers, and ion trap mass analyzers. In each case, ions produced from the sample by the ion source are introduced using a variety of ion optics to guide the charged particles into the analyzer.

In a time-of-flight analyzer, the collection of ions are first accelerated through a region of known electric potential change. This gives each particle with the same charge the same amount of kinetic energy. The collection of accelerated ions are then allowed to travel through a region of zero electric field, and the time of their arrival at a detector at the end of this region is recorded. Particles with the same kinetic energy but different masses will travel through the "drift" region at different speeds, and thus reach the detector at different times. By this method the mass-to-charge ratio can be determined for each particle sensed by the detector.

A quadrupole mass analyzer operates by accepting the collection of ions into a region of oscillating electric field. By varying the parameters of this electric field the region can be made stable for a range of different mass-to-charge ratios. The quadrupole mass analyzer determines the mass-to-charge ratios for a variety of charged particles by quickly scanning through these stability parameters, keeping track of how many particles for each mass-to-charge ratio scanned through are detected.

An ion trap mass analyzer operates in a similar manner, but is capable of producing a field that is capable of trapping a number of particles with a range of mass-to-charge particles. The trap can modify the range of mass-to-charge ratios which are trapped, and thus by narrowing the stability region of operation certain mass-to-charge ratio particles can be released from the trap one by one and allowed to reach a detector outside, and the mass-to-charge ratio information recorded by the system. Other types of ion traps are capable of detecting the mass-to-charge ratio of charged particles in the trap without releasing them. This is accomplished by measuring the oscillation frequency of such particles in the trap by detecting the electromagnetic fields they produce, and analyzing the resulting data.

The use of electron, ion, and laser beams as an ion source for mass spectrometry-based imaging of surface and tissues is well known. Two popular approaches currently used are matrix assisted laser desportion ionization (MALDI) and secondary ion mass spectrometry (SIMS). These techniques are limited to monitoring the desorbed ion yields under high vacuum conditions and have been used to image semiconductor surfaces, insulators, polymers, tissues, and histological samples. Most MALDI and laser desorption/ionization based mass spectrometry approaches, however, are not effective under ambient temperature and pressure conditions. Some approaches such as desorption electrospary ionization (DESI), direct analysis in real time (DART), and radiofrequency plasma assisted desorption ionization (PADI) have been successfully used under ambient conditions. The spatial resolution of these approaches, however, is limited to the mm scale due to limitations inherent in the technology, and their reliance upon detecting ion signals produced as a result of surface or above surface interactions.

Therefore, there remains a need for an ion source capable of operating under ambient conditions which can be used to analyze condensed-phase targets such as liquids and surfaces with improved spatial resolution. The embodiments of the invention described below meet this need.

BRIEF SUMMARY OF THE INVENTION

Embodiments of the present invention are directed to a method and system for desorption and ionization of a sample for analysis via mass spectrometry using a microplasma device. Embodiments of the present invention rely upon a microplasma device, or an array of such devices, to partially ionize a gas to form a plasma. The ionized gas can be any pure gas or mixture of gasses, including air, argon, helium, neon. The addition of hydrogen ($H_2$) to the rare gas plasma can produce high energy vacuum ultraviolet photons, which can aid in the desorption/ionization process. The gas effluent stream from the plasma, containing electrons, photons, ions, and metastable particles can be directed onto the surface of a sample to desorb and remove molecules from the sample. These desorbed molecules can be ionized by the plasma effluent as they leave the surface of the sample in the path of the effluent stream. The ionization process can include: electron impact ionization, photo-ionization, penning ionization, and chemical ionization (proton transfer). The ionized particles from the sample can be directed to a mass spectrometer for analysis.

The ionization attained by embodiments of the present invention can occur under ambient temperature and pressure conditions. The ionization achieved by the embodiments of the present invention is preferably primarily a non-thermal process, therefore, thermal fragmentation and damage to the sample is minimized or eliminated. The addition of hydrogen into the gas mixture increases the proton transfer probability and also produces Lyman-$\alpha$ photons. These photons can lead to further desorption and photo-ionization.

Embodiments of the present invention can be employed to ionize a wide variety of solid surfaces, including skin or cell cultures, or liquid samples. Embodiments of the present invention can be applied to mass spectrometry for surface analysis, proteomics, metabolomics, glycomics, cancer research, and studies of drug discovery and immune response.

Embodiments of the present invention can pair microscopy with mass spectrometry. A microplasma device can be disposed inline with a microscope. The microscope and sample can translate relative the microplasma device to position a desired area of the sample in the path of the effluent plume. In this manner, a specific area of a sample can be selected for analysis by mass spectrometry.

In an exemplary embodiment of the invention, a method for analyzing a sample using a microplasma device and a mass spectrometer comprises generating a field by exciting a first electrode and a second electrode separated by a dielectric element and injecting a gas through a first aperture to form a plasma, the first aperture traversing the first electrode, the second electrode, and the dielectric. The method further comprises directing an effluent stream from the first aperture onto a target surface of the sample and desorbing and ionizing molecules from the target surface using the effluent stream. The method additionally comprises deflecting the paths of the ionized molecules to a mass analyzer and determining the composition of the molecules In an exemplary embodiment of the invention, the method for comprise an imaging mass spectrometry system comprises an ion source comprising a first electrode, a second electrode, a dielectric element disposed between the first and second electrodes, and a first aperture traversing the first electrode, second electrode, and dielectric element. The system further comprises a mass analyzer and a device for detecting charged particles.

In an exemplary embodiment of the invention, an ion source for an imaging mass spectrometry system, the ion source comprises a first electrode, a second electrode, and a dielectric element disposed between the electrodes. The ion source further comprises a first aperture traversing the first electrode, second electrode, and dielectric element, wherein a excitation of the first and second electrode transforms a gas flowing through the first aperture into a plasma, the first aperture adapted to direct a effluent stream of the plasma onto the surface of a sample to desorb molecules from the surface.

The Detailed Description and accompanying Drawings further describe these and other exemplary embodiments of a system and method for spatially-resolved chemical analysis using microplasma desorption and ionization of a sample.

DETAILED DESCRIPTION OF PREFERRED EMBODIMENTS

Figure 1A:
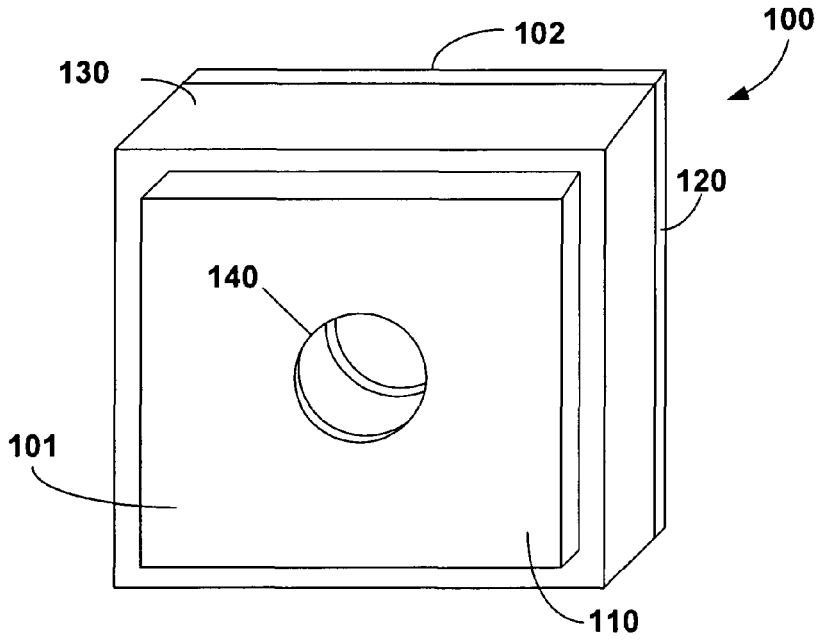
FIG. 1A illustrates an exemplary embodiment of a microplasma device.

Referring now in detail to the drawing figures, wherein like reference numerals represent like parts throughout the several views, FIG. 1A illustrates a frontal perspective view of an exemplary embodiment of a microplasma device. In all of the Figures, the microplasma device(s) and features thereof are not illustrated to scale. The Figures are intended to clearly illustrate all of the elements and their functional relationships, rather than actual relative proportions. The microplasma device 100 can comprise a first electrode 110 and a second electrode 120. The first and second electrodes, 110 and 120 can be separated by a dielectric 130. The microplasma device 100 can comprises a first side 101 and a second side 102.

The microplasma device 100 can further include an aperture 140. The aperture 140 can traverse the width of the microplasma device 100, forming a cylindrical channel through the first electrode 110, dielectric 130, and second electrode 120. The cross-section of aperture 140 is preferably circular.

The microplasma device 100 can have a thickness of 10-1000 μm. The electrodes 110 and 120 can each have a thickness of 100 nm-1000 μm. The diameter of the cross-section of the aperture 140 can be 10-1000 μm. In a preferred embodiment, the thickness of the microplasma device 100 can be 10-2000 μm, the thickness of the electrodes 110 and 120 can be 200 nm-1000 μm, and the diameter of the aperture 140 can be 10 μm-300 μm. The first electrode 101 can have a length and width less than that of the dielectric 130. This can reduce arcing between the electrodes 110 and 120 along the edges of the device 100 and formation of plasma at the edges as well. In other contemplated embodiments, the first electrode 110 can have the same length and width as the dielectric 130 and the second electrode 120 can have a smaller length and width than the dielectric 130. In further contemplated embodiments, insulation can be applied to the edges of electrode 110 and 120, enabling both electrodes 110 and 120 to have a width and length substantially equal to the dielectric 130. Additionally, it is contemplated that the first electrode 110 and the second electrode 120 can have a smaller length and width then the dielectric 130.

The electrodes 110 and 120 can be composed of a metal such as molybdenum or nickel. The dielectric can be composed of any suitable insulating material, such as silicon dioxide or polyamide.

The microplasma device 100 can generate a plasma by passing a gas through the aperture 140 while the electrodes 110 and 120 are excited by, for example applied AC or DC voltage, in either continuous or pulsed mode. In an exemplary embodiment, a gas can be injected through the aperture 140 from the first side 110 to the second side 120. The electrodes 110 and 120 can be excited by DC, radio-frequency, AC or a pulsed voltage. If the field strength within the aperture 140 exceeds a threshold value, the gas passing though the aperture 140 can become partially ionized and form a low temperature plasma.

Figure 1B:
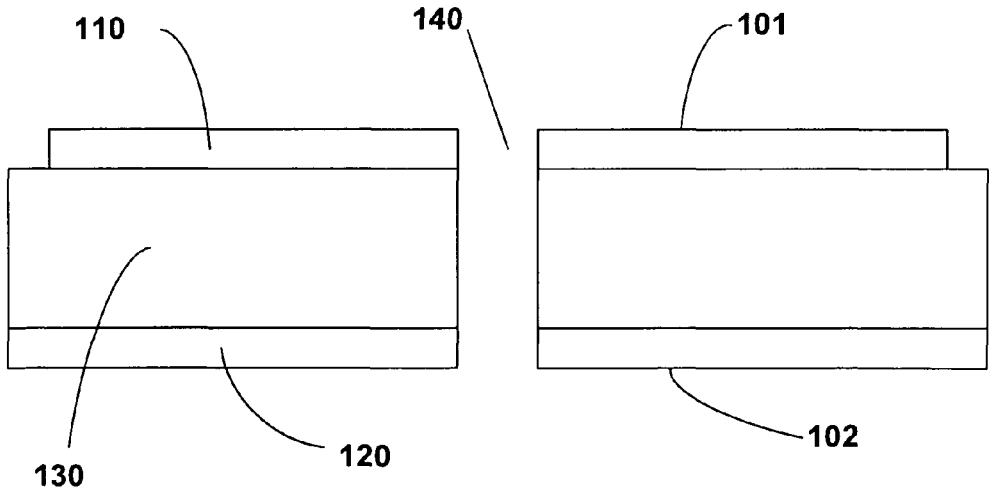
FIG. 1B illustrates a cross sectional view of an exemplary embodiment of microplasma device.

FIG. 1B illustrates a cross sectional view of an exemplary embodiment of a microplasma device 100. The dielectric 130 can be disposed between electrodes 110 and 120. The aperture 140 can traverse the entire thickness of the microplasma device 100. The first side 101 as illustrated is disposed at the top of the microplasma device 100 and the second side 102 is disposed at the bottom.

Figure 1C:
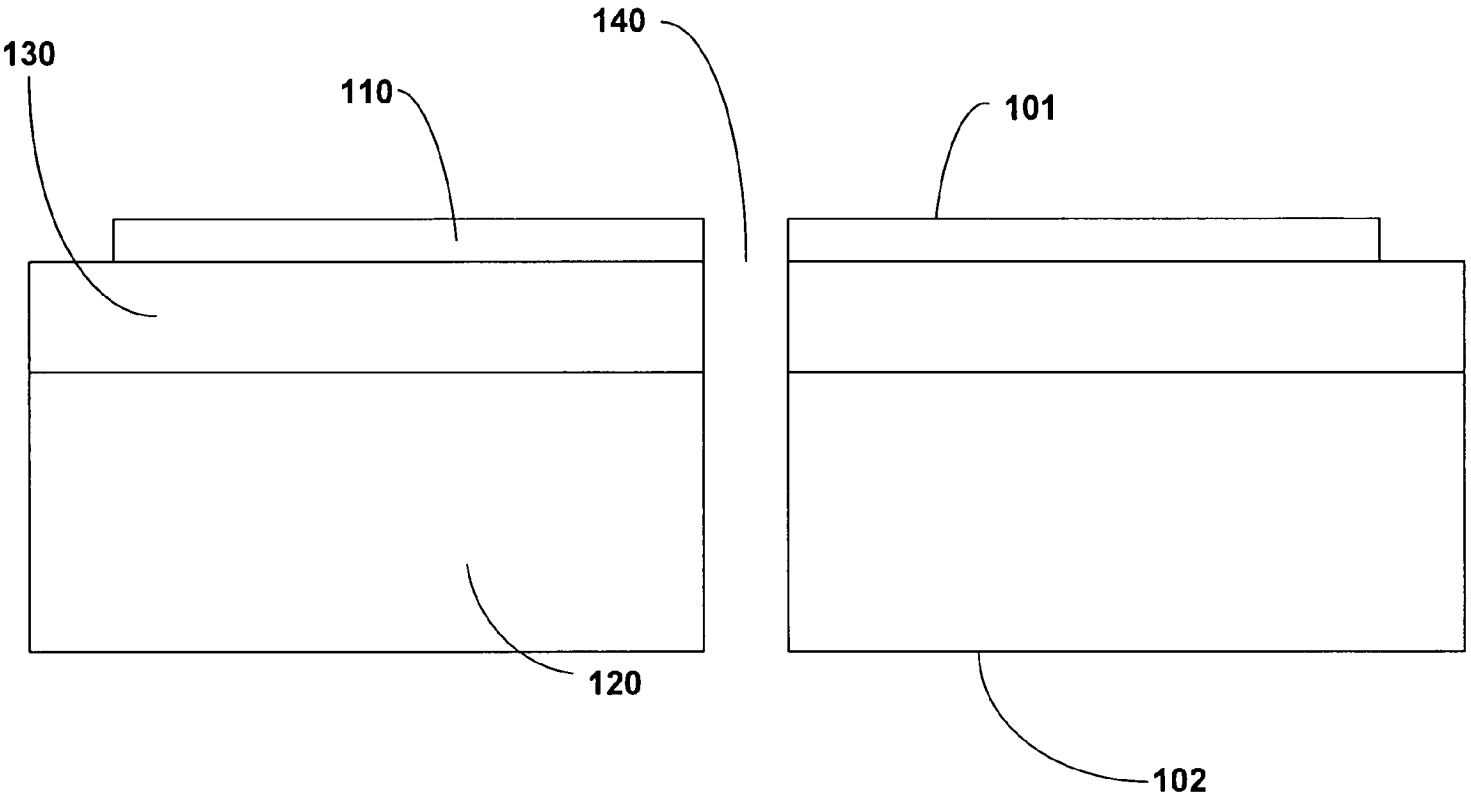
FIG. 1C illustrates a cross sectional view of an exemplary embodiment of the composition of a microplasma device.

FIG. 1C illustrates a cross sectional view of an exemplary embodiment of the composition of a microplasma device 100. The dielectric 130 can be disposed between electrodes 110 and 120. The aperture 140 can traverse the entire thickness of the microplasma device 100. The first side 101 as illustrated is disposed at the top of the microplasma device 100 and the second side 102 is disposed at the bottom.

The second electrode 120 can be a composed of a semiconductor or a conductor. For example, but not limitation, the second electrode can be composed of silicon (Si), nickel (Ni), or molybdenum (Mo). The dielectric 130 can be grown or deposited on the surface of the second electrode 120. For example, but not limitation, the dielectric 130 can be composed of silicon dioxide, mica, or polyamide. The first electrode 110 can be deposited on the surface of the dielectric 130. For example, but not limitation, the dielectric 130 can be composed of molybdenum (Mo). In other contemplated embodiments, the first electrode 110 can be composed of a semiconductor and the second electrode can be composed of a metal. In further contemplated embodiments, the electrodes 110 and 120 can both be composed of a metal or a semiconductor.

Figure 2:
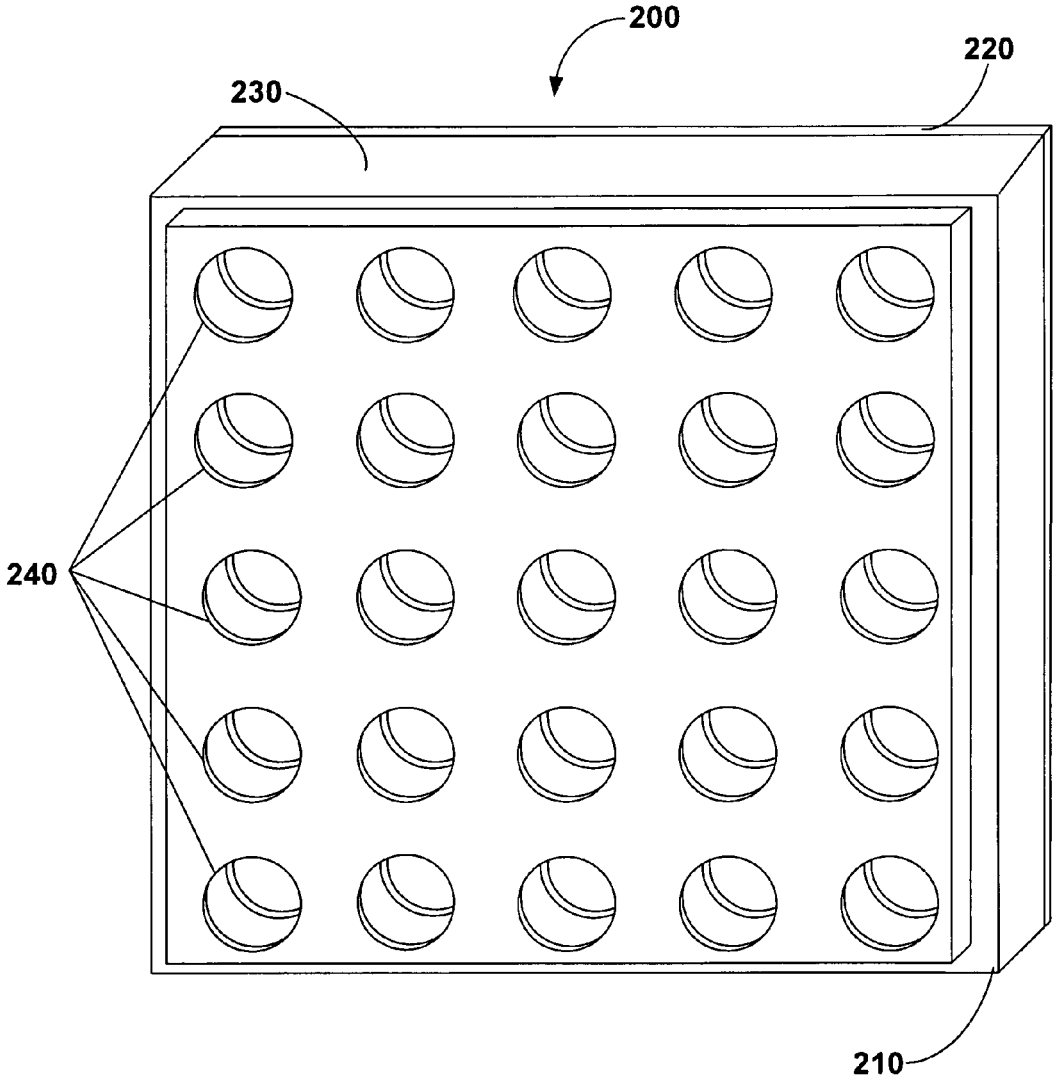
FIG. 2 illustrates an exemplary embodiment of a microplasma device array.

FIG. 2 illustrates an exemplary embodiment of a microplasma device array 200. The array 200 can be composed of a plurality of microplasma devices 100 as described above. The microplasma devices 100 can be integrally formed or coupled together to form the array 200.

FIG. 2 illustrates an embodiment wherein the array 200 can comprise 25 integrally formed microplasma devices 100. In other contemplated embodiments, the array 200 can comprise a different number of microplasma devices 100.

The array 200 can comprise a first electrode 210 and a second electrode 220. A dielectric 230 can be disposed between the electrodes 210 and 220. The array 200 can further comprise a plurality of apertures 240. In the illustrated embodiment, the array 200 comprises 25 apertures 240. The electrodes 210 and 220, the dielectric 230, and the apertures 240 can be substantially similar to the corresponding elements described above with regard to FIGS. 1A and 1B.

Figure 3:
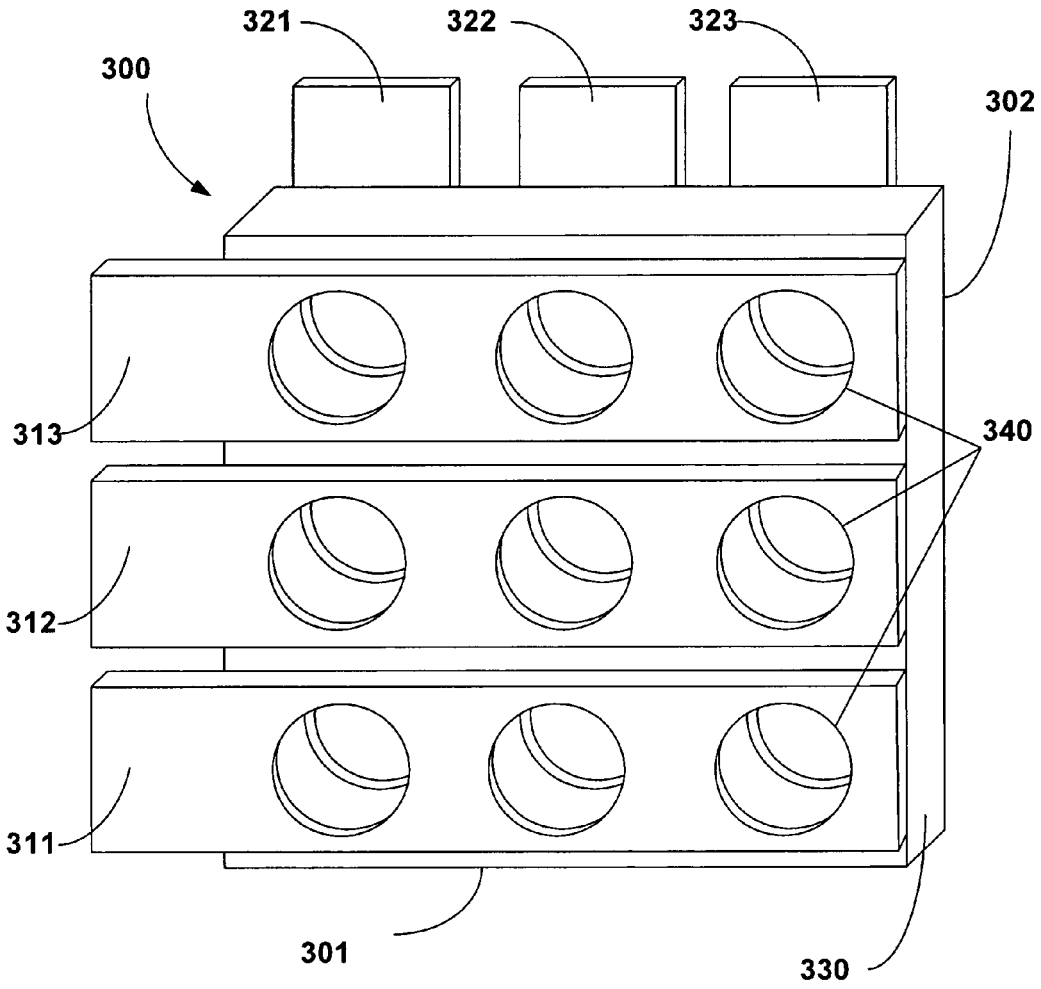
FIG. 3 illustrates an exemplary embodiment of the array having separately addressable electrodes.

FIG. 3 illustrates an exemplary embodiment of the array having separately addressable electrodes, which produce separately addressable plasmas. The array 300 can comprise a first front electrode 311, a second front electrode 312, and a third front electrode 313 disposed in parallel on the first side 301 of the array 300. The electrodes 311, 312, and 313 can traverse the width of a dielectric element 330. The array 300 can further comprise a first back electrode 321, a second back electrode 322, and a third back electrode 323 disposed in parallel on the second side 302 of the array. The electrodes 321, 322, and 323 can traverse the width of the dielectric element 330. The electrodes 311, 312, and 313 can be oriented parallel or orthogonal to electrodes 321, 322, and 323. In the illustrated example, the relative orientation is orthogonal.

The array 300 can comprise a plurality of apertures 340. The apertures traverse the thickness of the electrodes 311-313 and 321-323 and the dielectric 330. The apertures 340 can be substantially similar to the aperture 140 and 240 discussed above. FIG. 3 illustrates nine apertures 340. In other contemplated embodiments, other desired numbers of apertures can be employed.

The front electrodes 311, 312, 313 are preferably electrically isolated from each other. Similarly, the back electrodes 321, 322, and 323 are preferably electrically isolated from each other. Each of the electrodes 311-313 and 321-323 can be independently excited. For example, electrodes 312 and 322 can be excited while electrodes 311, 313, 321, and 323 are not excited. By selectively exciting certain electrodes, a magnetic and electric field can be generated in a desired aperture. For example, if electrode 313 and electrode 323 are excited, a field can be generated in the aperture in the upper right corner of the array 300.

By selectively generating a field in the apertures 340 in the array 300, desired portions of a sample surface can be ionized. Placing the array 300 above a sample surface, the area of the surface ionized by an effluent plume can be selected by exciting particular electrodes. This provides spatial mapping of the surface area of the sample. In this manner, portions of the sample can be analyzed by mass spectrometry separately without moving the sample or the array 300.

Figure 4:
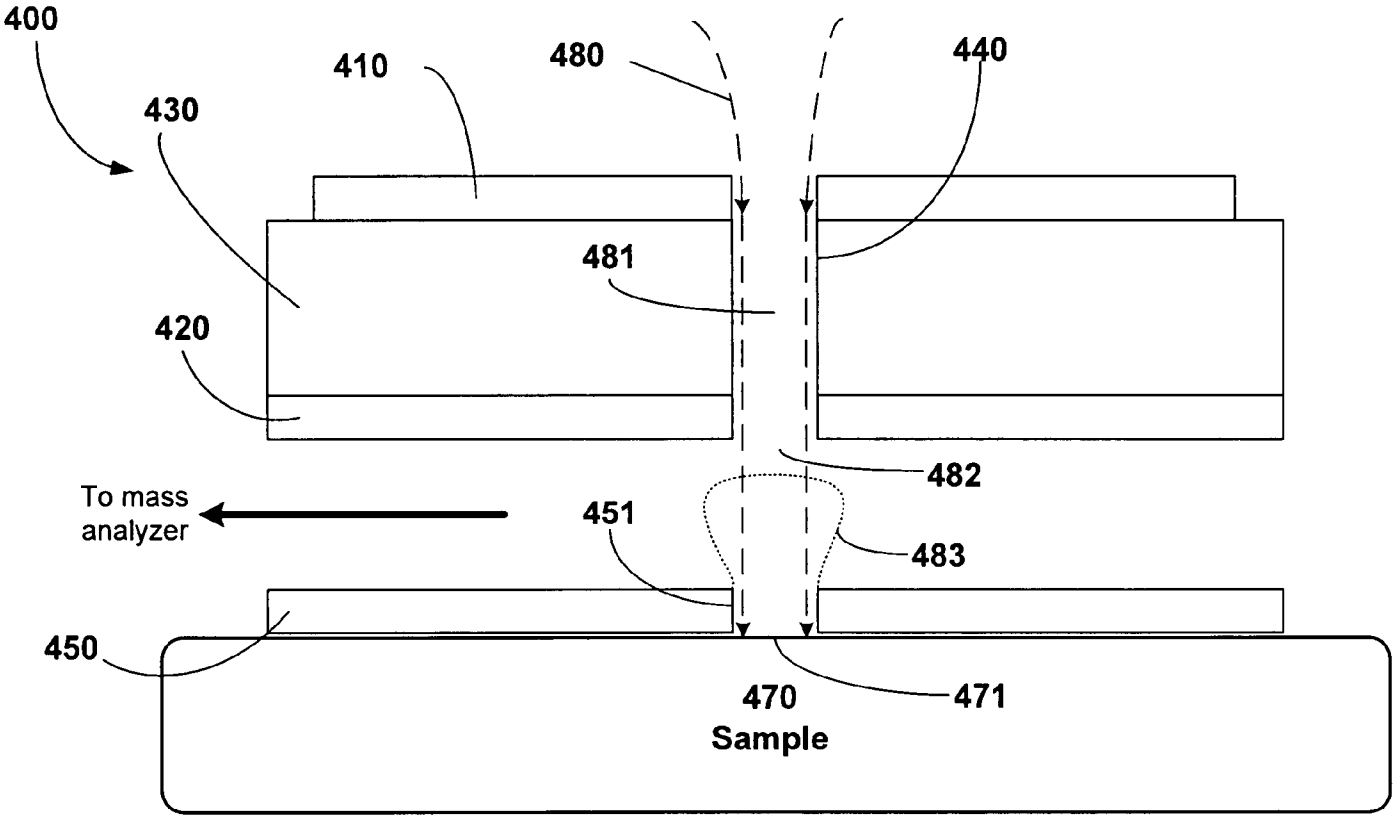
FIG. 4 illustrates a cross sectional view of an exemplary embodiment of a microplasma device in relation to a sample surface.

FIG. 4 illustrates a cross sectional view of an exemplary embodiment of a microplasma device 400 in relation to a sample 470 surface. The microplasma device 400 illustrated in FIG. 4 can be a stand alone device or represent a single device within an array as described above in FIGS. 2 and 3. The microplasma device 400 can comprise a first electrode 410 and a second electrode 420 separated by a dielectric 430. A first aperture 440 can traverse the thickness of the electrodes 410 and 420 and the dielectric 430. The aperture 440, electrodes 410 and 420 and dielectric 430 can be substantially similar to the corresponding elements described above with regard to FIGS. 1A and 1B.

The microplasma device 400 can further comprise a third electrode 450. The third electrode 450 can be substantially similar in dimension and composition to the second electrode 420. The third electrode 450 can be disposed substantially parallel to the second electrode 420. The third electrode 450 can be spaced apart from the electrode, preferably no further than 1 mm. The distance between the third electrode 450 and second electrode 420 can vary between embodiments and applications of the microplasma device 400. The third electrode 450 can be unexcited and maintained at a ground potential, or excited with a varying or constant potential.

The third electrode 450 can comprise a second aperture 451. The second aperture 451 can traverse the thickness of the third electrode. The second aperture 451 can be concentrically aligned with the first aperture 440 and similar or smaller in diameter to the first aperture 440.

The microplasma device 400 can be positioned over the surface of a sample 470. The sample 470 and/or microplasma device 400 can be positioned such that the second aperture 450 is directly above a target site 471 that is to be analyzed.

A gas mixture 480 can be injected through the first aperture 440. The gas mixture 480 is preferably composed of molecules that may be readily ionized to form a plasma. The mixture 480 can comprise different types of molecules or a single type of molecule or atom. In an exemplary embodiment, the mixture comprises neon and hydrogen. In other embodiments, the gas 480 may comprise neon or another noble gas alone, or a mixture such as air.

The field generated by the excitation of electrodes 410 and 420 can partially ionize the gas mixture 480. In an exemplary embodiment, the first electrode 410 can be an anode and the second electrode 420 can be a cathode. In other contemplated embodiments, the first electrode 410 can be a cathode and the second electrode 420 can be an anode, in this configuration the field generated within the aperture 440 can minimize the number of ionized particles passing through the aperture 440, allowing primarily VUV photons to pass therethrough. As described above, in each of the exemplary embodiments, the excitation source can be a pulsed voltage. A pulsed voltage can result in an increase in the concentration of metastables and VUV photons produced, as well as reducing the increase in temperature of the plasma 481. The gas mixture 480 forms a plasma 481 as it passes through the aperture 440. The plasma 481 can comprise metastable particles, highly excited hydrogen atoms and molecules, high energy electrons, high energy photons, and other ions. A plasma effluent stream 482 can be ejected from the aperture 440 and continue to diffuse across the gap between the second electrode 420 and the third electrode 450. The effluent stream 482 can comprise energetic electrons, VUV photons, metastable particles, ions, and neutral gas. Upon reaching the third electrode 450 and passing through the second aperture 451, the effluent stream 482 can interact with the target site 471. The interaction of the effluent stream 482 with the surface of sample 470 can be delimited by the diameter of the aperture 451. The diameter of aperture 451 can be selected to correspond to the area of the surface of sample 470 that is desired to be analyzed. Accordingly, the diameter of aperture 451 can be different from the diameter of aperture 440.

The interaction between the effluent stream 482 and the target site 471 can desorb and remove molecules from the sample 470. The metastable molecules in the effluent stream 482 can transfer energy in collisions with the sample, breaking apart bonds between molecules of the sample, and between atoms and molecules on the sample. Further, the excited hydrogen molecules emit photons in the VUV wavelength also breaking apart bonds. The primary VUV photons assist in removing atoms and molecules from the surface. This process of desorption and removal from the surface of the target site 471 with the effluent stream 482 can be primarily nonthermal. In other embodiments, thermal desorption may be occurring in conjunction with nonthermal desportion. The combination of metastables, excited hydrogen molecules, electrons, photons, and ions in the effluent stream 482 can efficiently desorb molecules from the surface of the target site without thermal damage occurring to the remainder of the sample 470.

The desorbed molecules from the target site 471 are ejected from the surface of the sample 470 and can form a plume 483 located directly above the target site 471. As the desorbed sample molecules are ejected forming plume 483, the molecules in the plume 483 can be ionized by the effluent stream 482, which passes through the plume 483. The effluent stream 482 can ionize the sample molecules in the plume 483 through one or more possible ionization channels. The metastable molecules in the effluent stream 482 can ionize the sample molecules in the plume 483 through penning ionization. Further, the excited hydrogen molecules can emit VUV photons, which photoionize the molecules. Additionally, proton transfer ionization can occur given the presence of water.

Figure 5A:
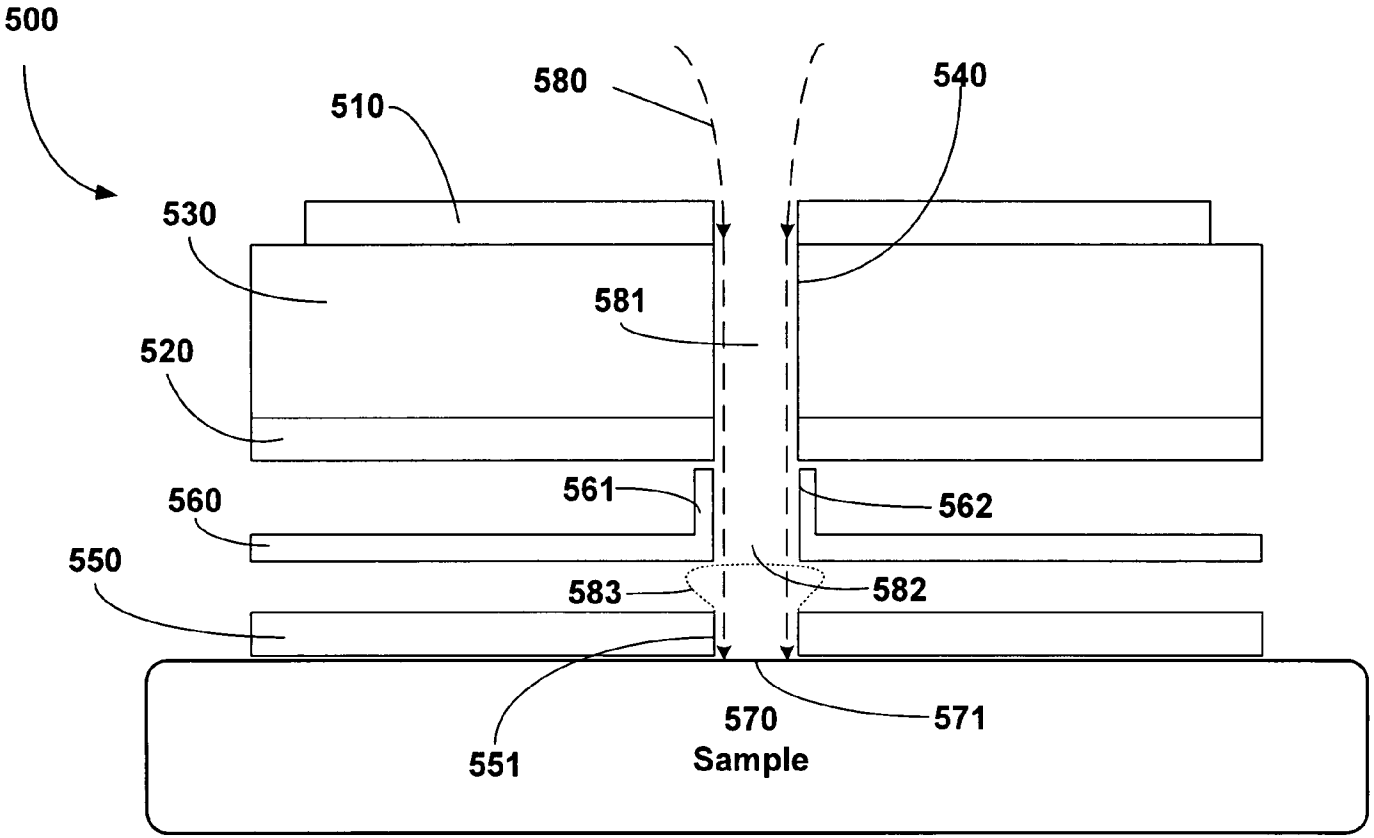
FIG. 5A illustrates a cross sectional view of an exemplary embodiment of a microplasma device with a guide electrode.

FIG. 5A illustrates a cross sectional view of an exemplary embodiment of a microplasma device 500 with a guide electrode. The microplasma device 500 illustrated in FIG. 5 can be a stand alone device or represent a single device within an array as described above in FIGS. 2 and 3. The microplasma device 500 can comprise a first electrode 510 and a second electrode 520 separated by a dielectric 530. A first aperture 540 can traverse the thickness of the electrodes 510 and 520 and the dielectric 530. The device 500 can further comprise a third electrode 550 having a second aperture 551. The apertures 540 and 551, electrodes 510, 520, and 550, and dielectric 530 can be substantially similar to the corresponding elements described above with regard to FIG. 4.

The microplasma device 500 can further comprise a fourth electrode 560. The fourth electrode 560 can be disposed between the second electrode 520 and the third electrode 550. The fourth electrode 560 is preferably substantially parallel to the second electrode 520 and third electrode 550 and spaced apart approximately 1 mm between the second 520 and third 550 electrodes.

The fourth electrode 560 can comprise a cylindrical wall 561 orthogonal to the surface of the fourth electrode 560. The wall 561 can define a cylindrical conduit 562. The conduit 562 can be substantially similar in diameter to the first aperture 540. The conduit 562 can be concentrically aligned with the first aperture 540.

A gas 580 can be injected through first aperture 540 to form a plasma 581. This process is substantially similar to the plasma formation process described above. The effluent stream 582 can continue through the conduit 562 upon exiting the first aperture 540. The fourth electrode 560 can be excited to generate an electric and magnetic field within the conduit 562. The field within the conduit 562 can serve multiple functions. First, the field can block the passage of ions within the effluent plume 582. Second, the field can focus the effluent stream 582 and minimize the spreading of charged particles exiting the first aperture 540. This can concentrate the stream 582 and increase the portion of the effluent stream 582 that passes through the second aperture 552 and interacts with the target site 571 of the surface of the sample 570. This can also be used to remove cations and focus a beam of electrons and negative ions from the effluent stream 582. This would allow mass spectrometry of negative ions from the sample. Absent the fourth electrode 560, the effluent stream 582 may spread to a diameter greater than the diameter of the second aperture 551, consequently not all the charged particles in the plume 581 may reach the target site 571. The effluent steam 582 can interact with the target site 571 to form a plume 583 in substantially the same manner as described above.

Figure 5B:
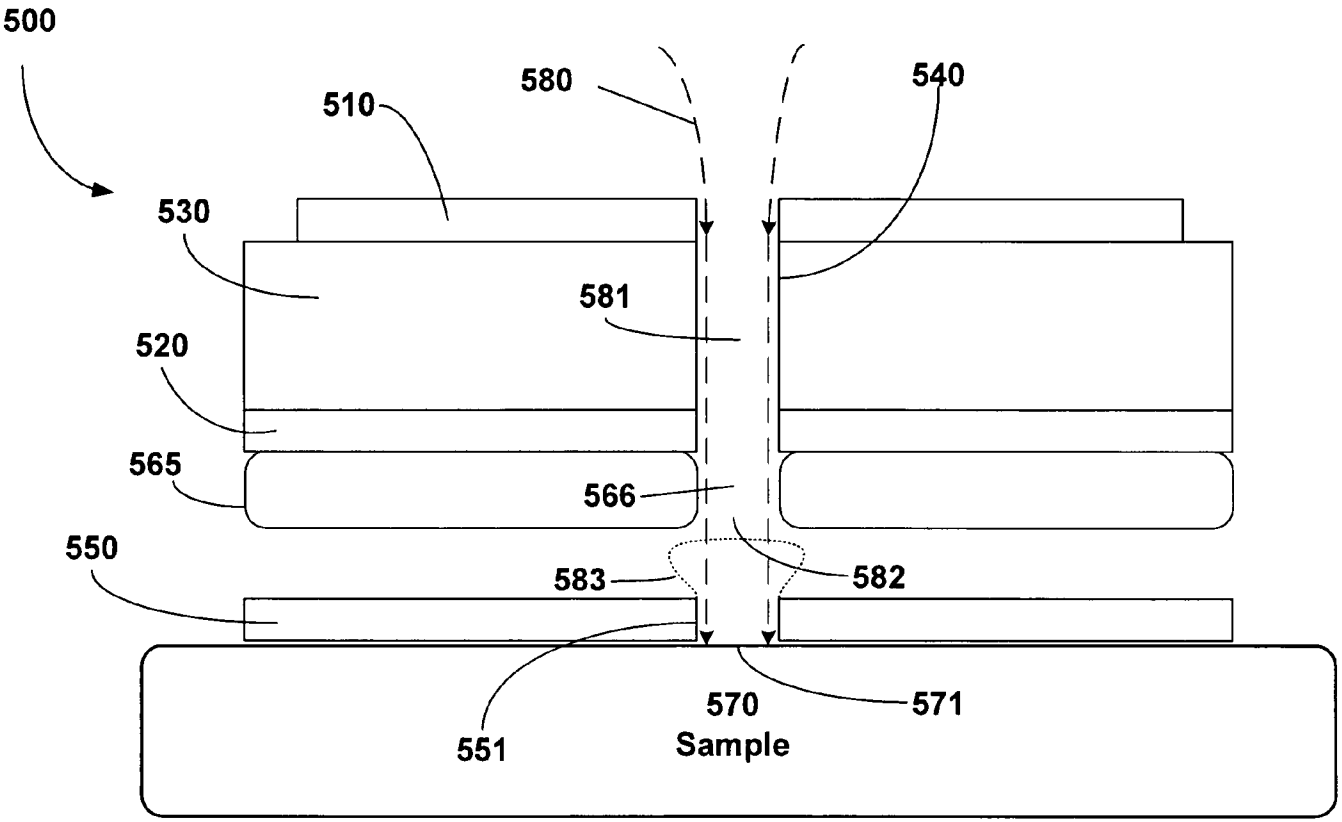
FIG. 5B illustrates a cross sectional view of an exemplary embodiment of a microplasma device with a solenoid.

FIG. 5B illustrates a cross sectional view of an exemplary embodiment of a microplasma device 500 with a solenoid 565. In other contemplated embodiments, the solenoid can encompass the microplasma device 550 and the sample 570. The microplasma device 500 can be substantially similar to the device illustrated in FIG. 5A. In the embodiment illustrated in FIG. 5B, however, the fourth electrode 560 can be replaced with a solenoid 565. The solenoid 565 can be disposed proximate the second electrode 520. The solenoid 565 can define a solenoid aperture 566. The solenoid aperture 566 can be substantially equal in diameter to and concentrically aligned with the first aperture 540.

The solenoid 565 can comprise helically stacked conductor coils, coplanar spiraling coils, or a combination of both. A DC voltage can be applied to the solenoid 565 to generate a magnetic field passing through the aperture 566. The magnetic field can serve to focus the effluent stream 582 or to prevent charged particles from passing through the aperture 566. In this manner, the solenoid 565 can serve as either a focusing lens or a filter. In other contemplated embodiments, the solenoid 565 can serve as both a lens and a filter.

The embodiments of the microplasma device 400 and 500 can be employed as an ion source for a mass spectrometer.

The embodiments of the microplasma device 400 and 500 desorb molecules from a sample surface and ionize the molecules in the resulting plume. In these embodiments, the devices 400 and 500 are not sealed off from ambient air. These embodiments rely upon extraction and transport of the ionized sample molecules from the surface of a target site to a mass analyzer of a mass spectrometer. The following exemplary embodiment discloses a microplasma device that is sealed off from ambient air and comprises channels for directing flow of gasses.

Figure 6A:
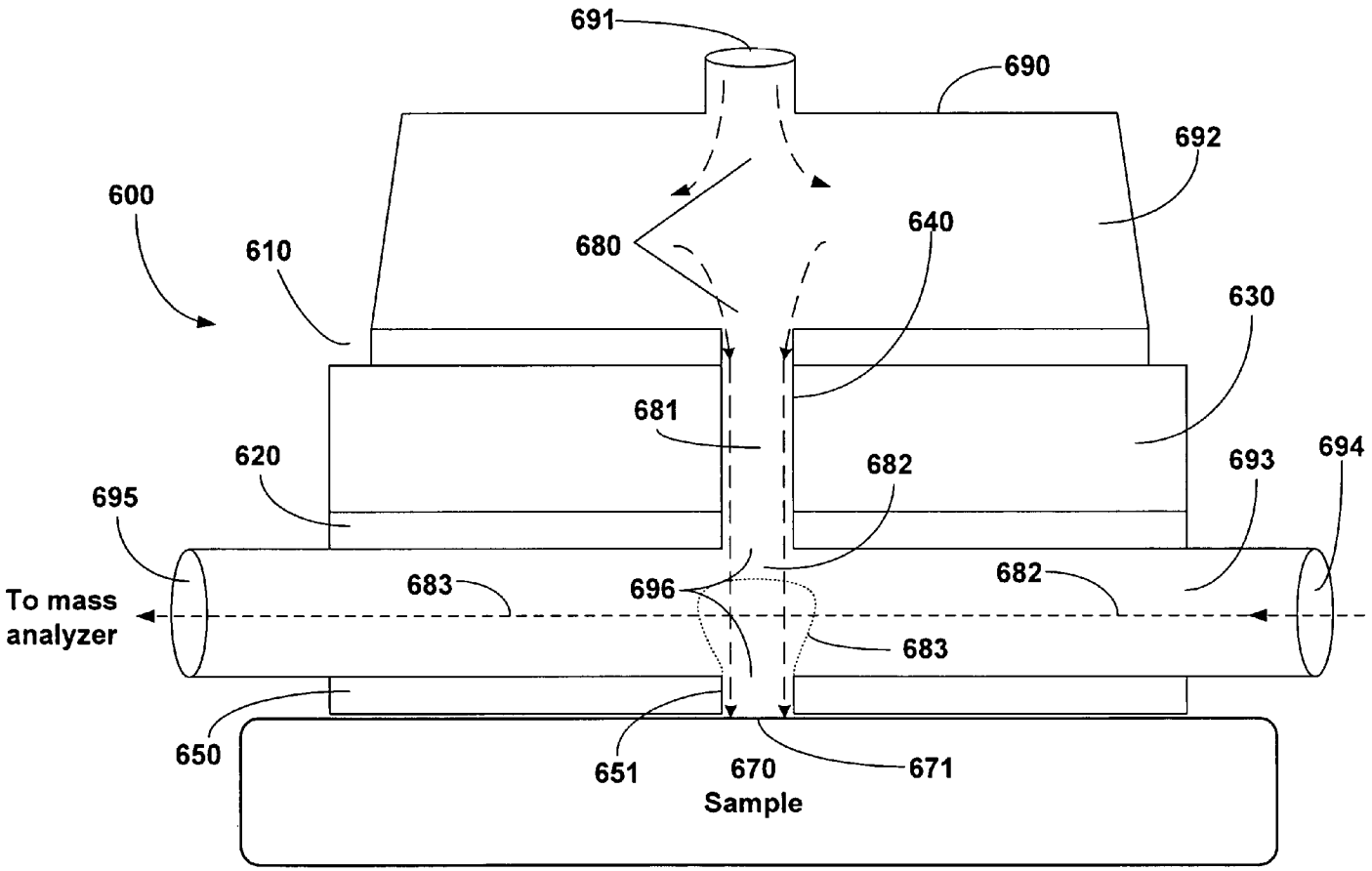
FIG. 6A illustrates a cross sectional view of an exemplary embodiment of a sealed microplasma device.

FIG. 6 illustrates a cross sectional view of an exemplary embodiment of a sealed microplasma device 600. The microplasma device 600 illustrated in FIG. 6 can be a stand alone device or represent a single device within an array as described above in FIGS. 2 and 3. The microplasma device 600 can comprise a first electrode 610 and a second electrode 620 separated by a dielectric 630. A first aperture 640 can traverse the thickness of the electrodes 610 and 620 and the dielectric 630. The device 600 can further comprise a third electrode 650 having a second aperture 651. The apertures 640 and 651, electrodes 610, 620, and 650, and dielectric 630 can be substantially similar to the corresponding elements described above with regard to FIG. 4. In another contemplated embodiment, the device 600 can comprise a fourth electrode substantially similar to the fourth electrode described above with regard to FIG. 5.

The device 600 can further comprise an enclosure 690 substantially surrounding the outer portion of the first electrode 610. The enclosure 690 can be dome shaped, square, or another suitable configuration. The enclosure 690 can define a chamber 692. A gas mixture 680 can be injected through a first port 691 in the enclosure 690 into the chamber 692. The gas mixture 680 can be substantially similar to the gas mixtures described above. The gas 680 can flow from the chamber 692 through the first aperture 640. The injection of the gas 680 into the chamber 692 and resulting passage through first aperture 640 can be pulsed.

As the first and second electrodes 610 and 620 are excited, the gas 680 can form a plasma 681. The plasma 681 can flow from the first aperture 640 through the second aperture 651 where it can interact with the target site 671 on the surface of sample 670. The effluent stream 682 can desorb molecules from the surface of sample 670 at the target site 671 and ionize the molecules after they have broken away from the surface. In contemplated embodiments, the effluent stream 682 can ionize molecules from the target site 671 as the molecules are bring desorbed.

The device 600 can further comprise a tube 693 disposed parallel to and between the second 620 and third 650 electrodes. The tube 693 can traverse the width of the device 600. The tube 693 can comprise portals 696 aligned with the first aperture 640 and second aperture 651. The portals 696 can allow the effluent stream 682 to pass through the tube 693 as the effluent stream 682 flows from the first aperture 640 to the second aperture 651.

The tube 693 can further comprise an inlet port 694 and an outlet port 695. A transport gas 682 can be injected through the inlet port 694 and flow into the tube 693. As the transport gas 682 flows through the tube 693 it can direct the ionized fragments of the sample 670 above the target site 671 toward the outlet port 695. The sample gas 683 flowing toward the outlet port 695 can be a mixture of the transport gas 682 and ionized sample fragments. The outlet port 695 can lead to the mass analyzer of a mass spectrometer.

The embodiment described above in relation to FIG. 6 disclose a device 600 wherein the gas, ionizing plasma effluent stream, and ionized sample molecules are isolated from the ambient atmosphere. This embodiment enables transporting ionized sample fragments to a mass analyzer without contamination from, for example, the ambient air. This improves the accuracy of the sample analysis.

In embodiments wherein the device 600 comprises an array of microplasma devices, as described in FIGS. 2 and 3, the enclosure 690 can surround all of the apertures in the device. In other contemplated embodiments, each aperture can have a separate enclosure such that gas flow through each aperture can be independently regulated.

Figure 6B:
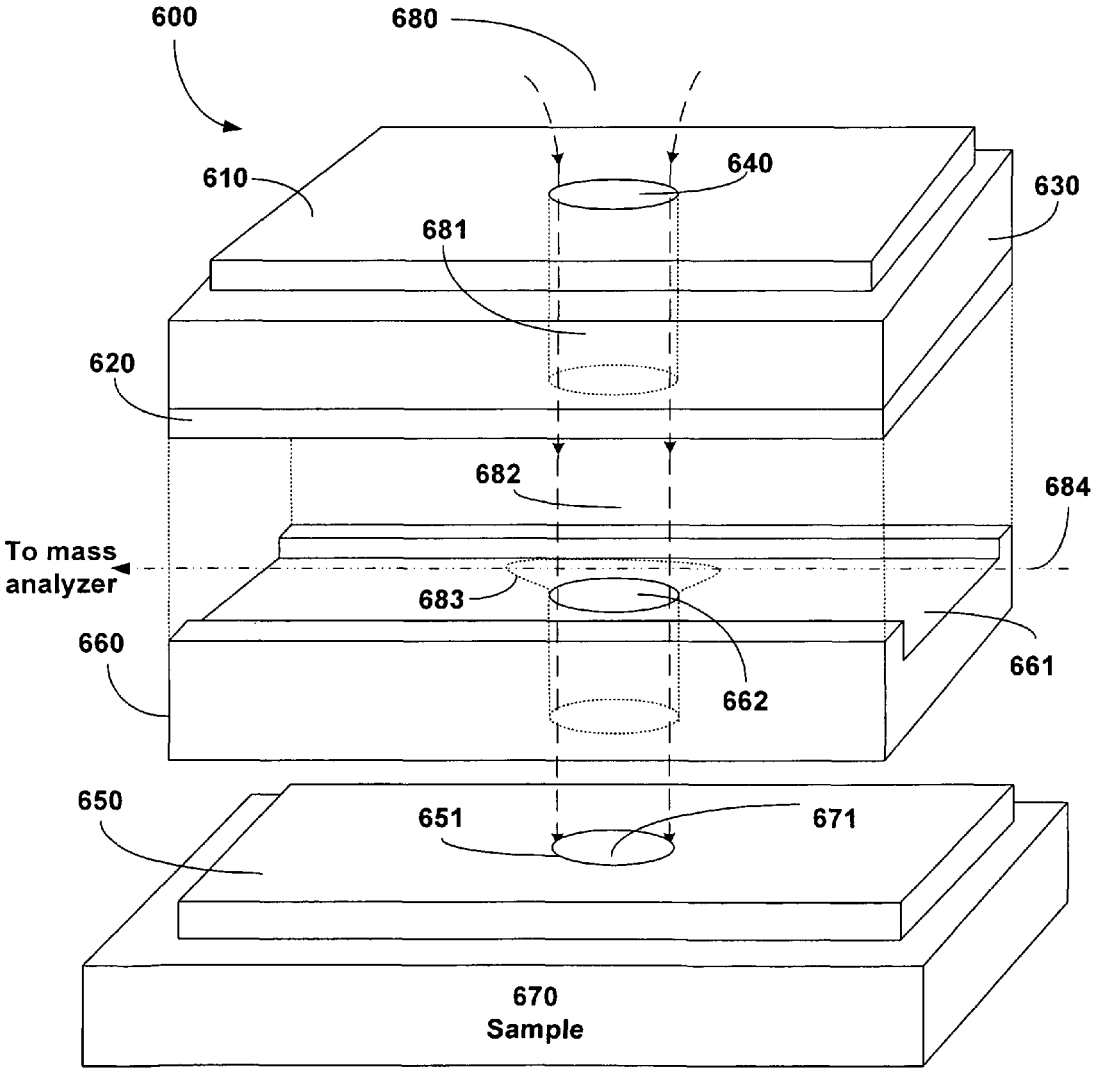
FIG. 6B illustrates an exploded perspective view of an exemplary embodiment of a sealed microplasma device with a gas transport channel.

FIG. 6B illustrates an exploded perspective view of an exemplary embodiment of a sealed microplasma device with a gas transport channel. The device 600 is substantially similar to the embodiment illustrated in FIG. 6A. The enclosure 690 is not pictured to simplify illustration. The present embodiment differs from that of FIG. 6A in that the tube 693 is replace with a channel element 660.

The channel element 660 can be disposed between the second 620 and third 650 electrodes. The element 660 can abut against both the electrode 620 and 650. The element 660 can comprise a channel 661 carved or other with formed along the entire width of the element 660. When the element 660 is proximate the second electrode 620, the channel 661 can define a conduit for conveying gas. The element 660 can comprise a channel aperture 662, substantially equal in diameter and concentrically aligned with the first aperture 640. The effluent stream 682 can pass through the channel aperture 662 and continue to the second aperture 651, where can interact with the target site 671 of sample 670 as described above. The plume 683 resulting can extend into the channel 661 above the aperture 662.

A transport or sweeper gas 684 can be injected into the channel 661 and carry matter from the plume 683 to a mass analyzer. The excitation of the electrode 610 and 620 can be pulsed as described above. Similarly, the injection of gas 684 can be pulsed and synchronized with excitation of the electrodes 610 and 620 to avoid diverting the effluent stream 682 to the mass analyzer, preventing it from reaching the target site 671. In other contemplated embodiments, the enclosure 690 can be omitted. In additional contemplated embodiments, the enclosure 690 can be incorporated in substantially similar form to all of the embodiments of the microplasma device(s) described herein.

Figure 7:
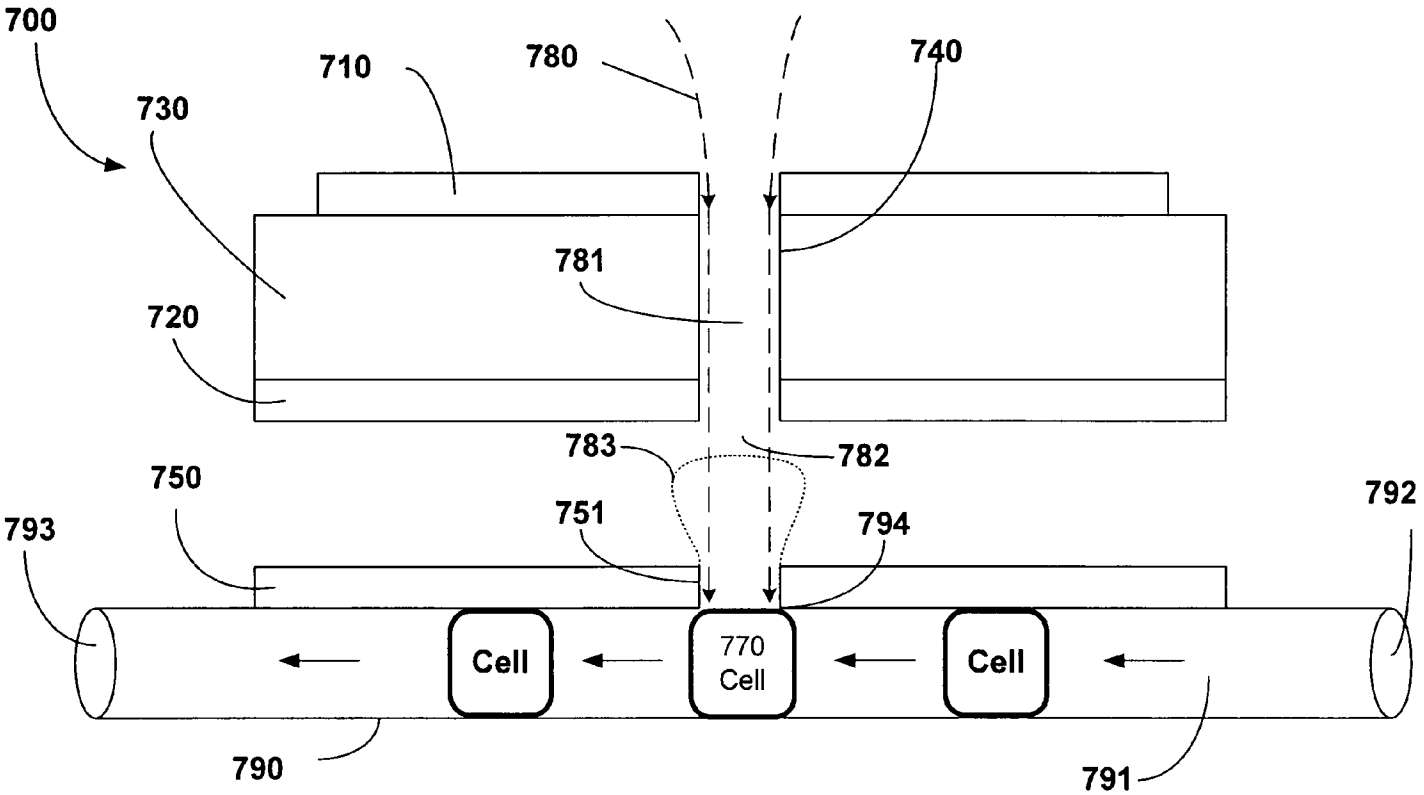
FIG. 7 illustrates a cross sectional view of an exemplary embodiment of a microplasma device for use with a microfluidic sample.

FIG. 7 illustrates a cross sectional view of an exemplary embodiment of a microplasma device 700 for use with a microfluidic sample. The microplasma device 700 illustrated in FIG. 7 can be a stand alone device or represent a single device within an array as described above in FIGS. 2 and 3. The microplasma device 700 can comprise a first electrode 710 and a second electrode 720 separated by a dielectric 730. A first aperture 70 can traverse the thickness of the electrodes 710 and 720 and the dielectric 730. The device 700 can further comprise a third electrode 750 having a second aperture 751. The apertures 740 and 751, electrodes 710, 720, and 750, and dielectric 730 can be substantially similar to the corresponding elements described above with regard to FIG. 4. In another contemplated embodiment, the device 700 can comprise a fourth electrode substantially similar to the fourth electrode described above with regard to FIG. 5.

The device 700 can further comprise a tube 790. The tube 790 can be a tube defining a conduit 791. The diameter of the conduit is preferably less than or equal to 1 mm. The channel can further comprise a portal 794 forming an opening between the second aperture 751 and the conduit 791. The portal 794 can be concentrically aligned with and approximately equal in diameter to the second aperture 751.

The tube 790 can further comprise an inlet port 792 and an outlet port 793. A sample can be injected through the inlet port 792 into the conduit 791. The sample can be a microfluidic specimen. For example, the sample 770 can be, but is not limited to, a cell, spore, or other biological entity. In other contemplated embodiments, the sample 770 can be a different micro scale specimen. The tube 790 can receive other fluid or fluidized samples as well. The diameter of the channel can be varied depending on the size and parameters of the sample to be analyzed. The sample 770 can flow through the conduit 791 toward the outlet port 793. As the sample 770 passes underneath the portal 794 it can be exposed to the effluent stream 782. The effluent stream 782 can fragment and ionize the surface of the sample proximate the portal 794 in substantially the same manner as described above. The ionized fragments of the sample 770 can be directed to a mass analyzer of a mass spectrometer. The sample 770 can continue along the conduit 791 and exit the tube 790 through the outlet port 793.

In other contemplated embodiments, a tube or channel element could be disposed between the second 720 and third electrodes 750 as described above with regard to FIGS. 6A and 6B. Further, tube 790 can be replaced by a channel element substantially similar to channel element 660 to transport a microfluidic sample.

Figure 8A:
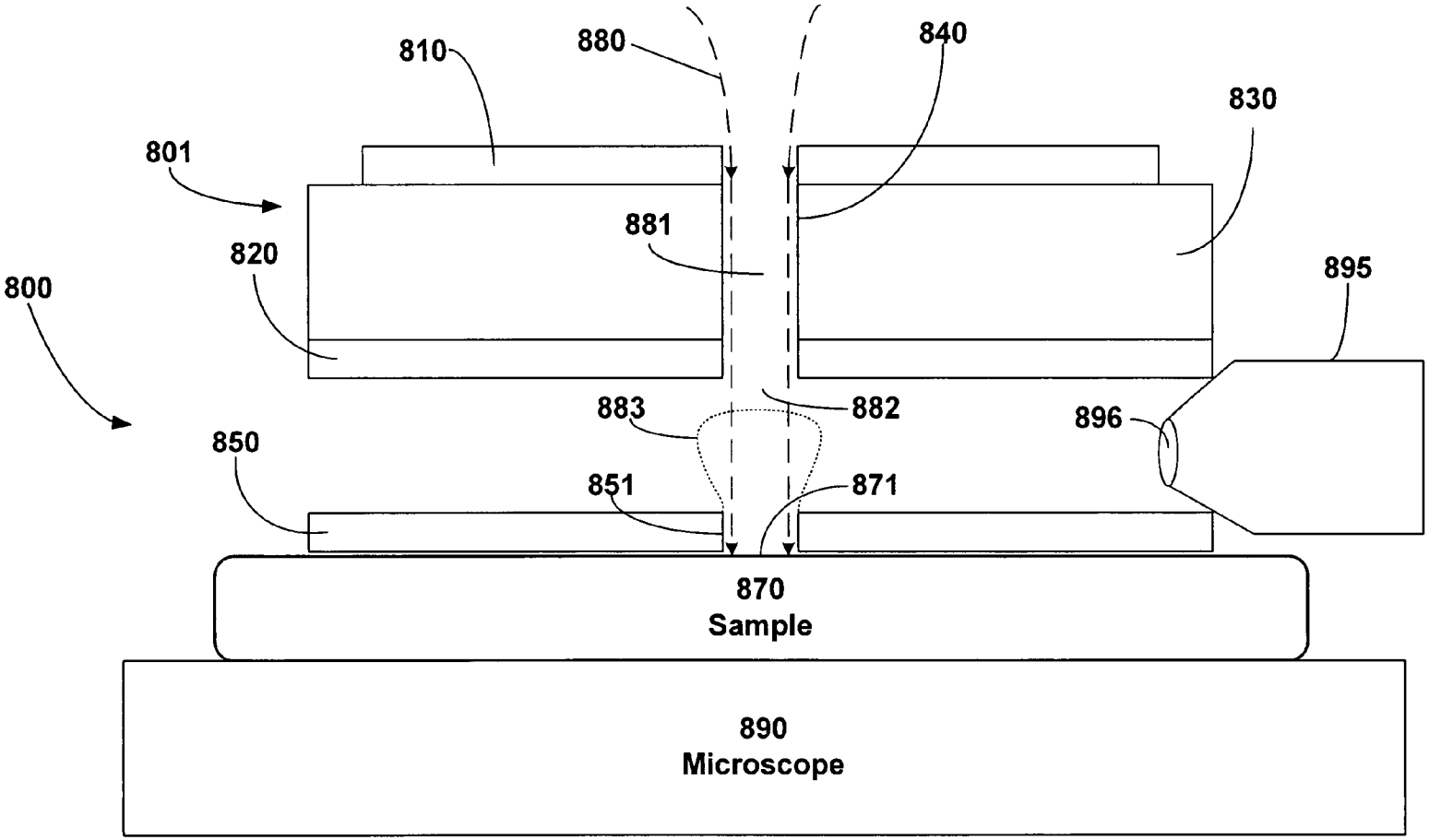
FIG. 8A illustrates a cross sectional view of an exemplary embodiment of a mass spectrometry analysis system.

FIG. 8A illustrates a cross sectional view of an exemplary embodiment of a mass spectrometry analysis system 800. The system 800 can comprise a microplasma device 801. The microplasma device 801 illustrated in FIG. 8 can be a stand alone device or represent a single device within an array as described above in FIGS. 2 and 3. The microplasma device 801 can comprise a first electrode 810 and a second electrode 820 separated by a dielectric 830. A first aperture 840 can traverse the thickness of the electrodes 810 and 820 and the dielectric 830. The device 801 can further comprise a third electrode 850 having a second aperture 851. The apertures 840 and 851, electrodes 810, 820, and 850, and dielectric 830 can be substantially similar to the corresponding elements described above with regard to FIG. 4. In another contemplated embodiment, the device 801 can comprise a fourth electrode substantially similar to the fourth electrode described above with regard to FIG. 5.

The system 800 can further comprise a microscope 890. The microscope 890 can be an optical microscope. For example, the microscope 890 can be a Raman microscope, a fluorescence microscope, and both near-field and far-field optical imaging systems. In other contemplated embodiments, the microscope 890 may be a microscope other than an optical microscope. In other contemplated embodiments, the microscope 890 can be replaced with another suitable imaging device.

The microscope 890 can be disposed inline with the device 801. In particular, the line of sight of the microscope can be parallel to the propagation axis of the effluent stream 882. In other contemplated embodiments, the line of sight of the microscope 890 can be offset from the axis of the effluent stream 882.

In an exemplary embodiment, the microscope 890 can be positioned to view a sample 870 from underneath. The sample 870 can be a specimen on a slide. In other embodiments, the sample can be any specimen suitable for imaging by a microscope. The device 801 can be positioned above the sample 870 and microscope 890. The microscope 890 can be used be used to locate the position of a target portion 871 or area within the sample 870. For example, the microscope 890 can be used to locate a particular cell within the sample 870. The target portion 871 may be anywhere within the sample 870. Because the sample 870 can be substantially larger than the aperture 851, the target portion 871 is not likely to be initially located directly underneath the aperture 851. Consequently, the target portion 871 might not be immediately ionized by the effluent stream 882.

After locating the target portion 871 within the sample 870, the microscope 890 and/or sample 870 can be repositioned such that the target portion 871 rests directly below the aperture 851. In this manner, a molecules at a particular target portion 871 can be desorbed and ionized by the effluent stream 882. The system 800 can further comprise a mass analyzer and detector 895 having an inlet port 896. The fragmented and ionized molecules from the target portion 871 of the sample 870 can be directed through the inlet port 896 for analysis. The optical analysis can also be performed simultaneously with the mass spectral imaging.

The embodiment described above of system 800 can incorporate various features of any of the previously described embodiments. For example, the device 801 can be sealed from ambient air, incorporating features of the embodiment illustrated in FIG. 6. The device 800 can also incorporate a fourth electrode as illustrated in FIG. 5. In other contemplated embodiments, the third electrode can be omitted. In further contemplated embodiments, a channel element substantially similar to element 660 can be disposed between the second 820 and third 850 electrodes to direct matter from the plume 883 to the mass analyzer 895. Additionally, in contemplated embodiments, the sample 870 can be a microfluidic sample within a tube or channel element substantially similar to those described above.

Figure 8B:
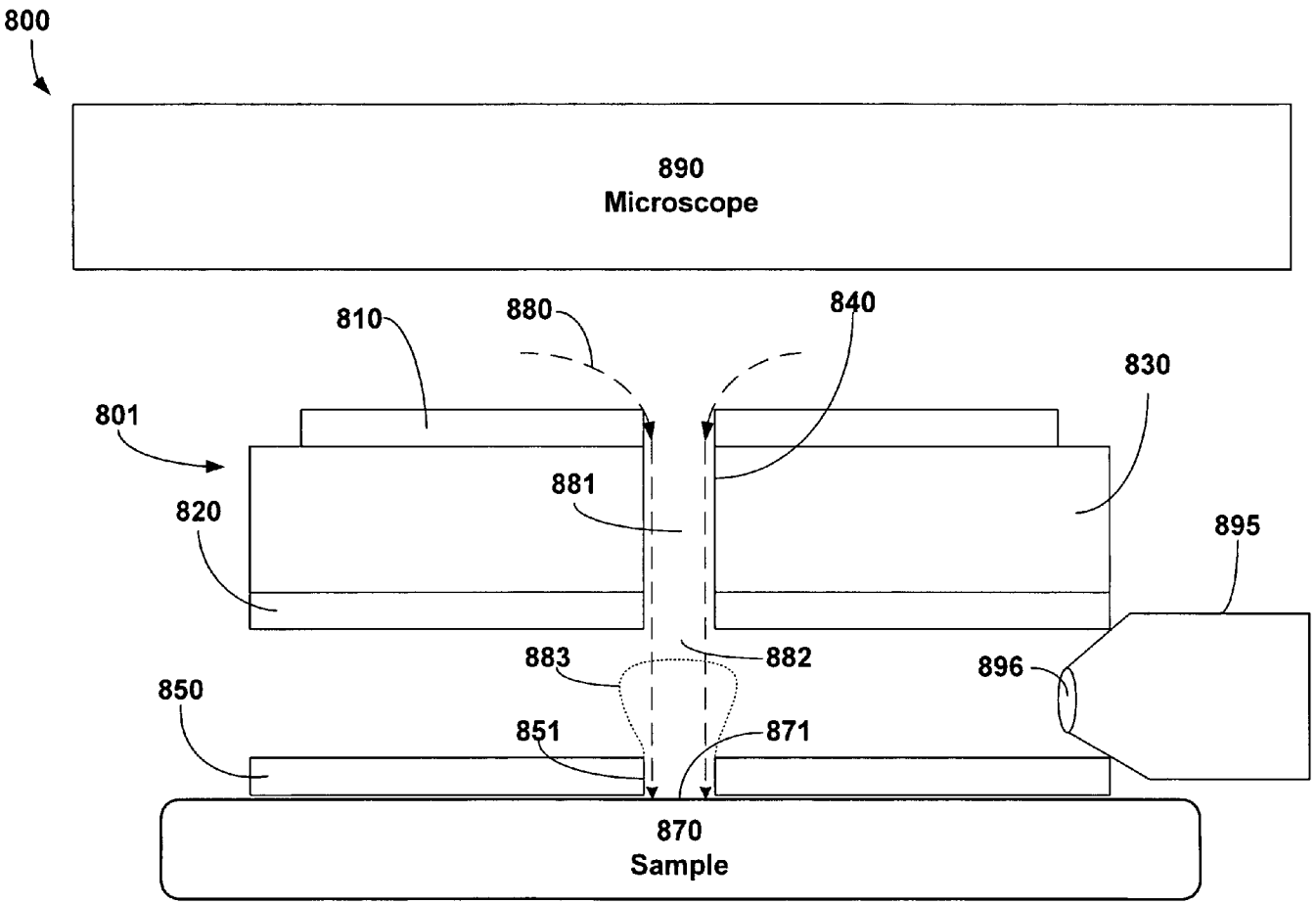
FIG. 8B illustrates a cross sectional view of alternative orientation of an exemplary embodiment of a mass spectrometry analysis system.

FIG. 8B illustrates a cross sectional view of alternative orientation of an exemplary embodiment of a mass spectrometry analysis system 800. The system 800 is substantially identical to the system described above in FIG. 8A. In this embodiment, however, the microscope 890 can be disposed above the device 801, which can be sandwiched between the microscope 890 and a sample 870. The line of sight of the microscope 890 can pass directly through the first aperture 840 and second aperture 851, allowing a user to see the target sight 871 on the sample 871. If the sample 870 is a cell culture and the target site 871 is a particular cell, this orientation allows a user to see the side of the cell that will be actually analyzed, rather than the bottom of said cell as in the orientation of FIG. 8A.

The embodiment variations described above with regard to FIG. 8A can also be applied to the embodiment of FIG. 8B. In particular, it is contemplated that a channel element substantially similar to element 660 can be disposed between the second 820 and third 850 electrodes to direct matter from the plume 883 to the mass analyzer 895. Additionally, it is contemplated that sample 870 can be a microfluidic sample within a tube or channel element substantially similar to those described above.

Figure 9A:
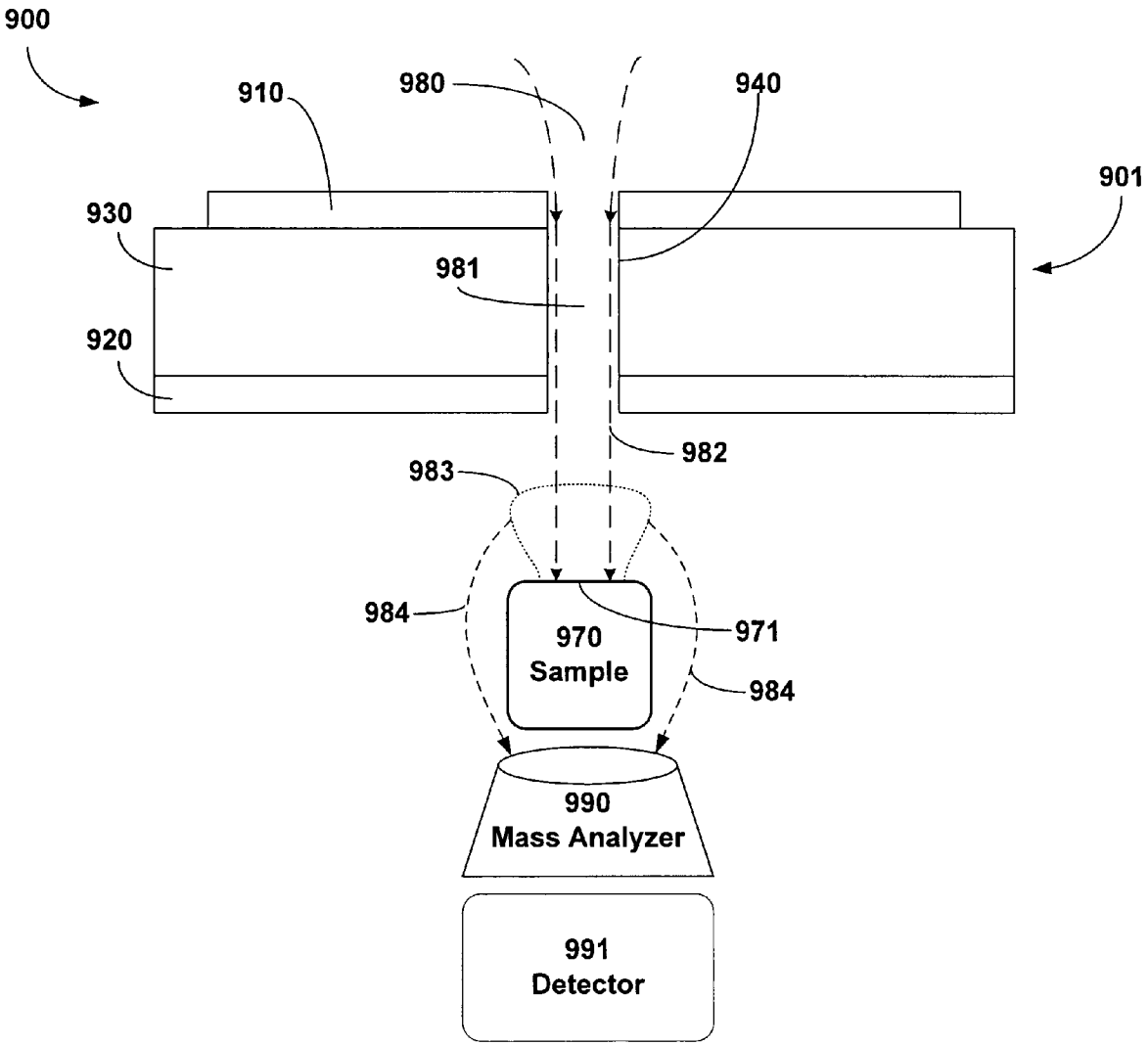
FIG. 9A illustrates a cross sectional view of an exemplary embodiment of a mass spectrometer comprising a microplasma ion source.

FIG. 9A illustrates a cross sectional view of an exemplary embodiment of a configuration for an imaging mass spectrometry system 900 comprising a microplasma ion source 901. The mass spectral imaging system 900 can comprise an ion source 901, a mass analyzer 990, and a detector 991. The ion source 901 can be a microplasma device in accordance with any of the embodiments described above.

In an exemplary embodiment, the ion source 901 can be a microplasma device comprising a first electrode 910, a second electrode 920, and a dielectric 930 disposed between the electrodes 910 and 920. The ion source 901 can further comprise an aperture 940 traversing the thickness of the electrodes 910 and 920 and the dielectric 930. The dimensions and function of the electrodes 910 and 920 and the dielectric 930 can be substantially similar to the corresponding elements described in the embodiments above. The ion source 901 can comprise a single microplasma device or an array of such devices as illustrated in FIGS. 2 and 3.

The electrodes 910 and 920 are designed to generate electric and magnetic fields. In particular, the electrodes 910 and 920, can be excited by DC, radio-frequency, AC or a pulsed voltage to generate an electric and magnetic field within the aperture 940. A gas 980 can be directed to flow through the aperture 940 to form a plasma 981. The composition of the gas 980 can be substantially similar to the gas mixtures described in relation to the embodiments disclosed above.

The effluent stream 982 from the aperture 940 can desorb and ionize molecules at a target portion 971 of the surface of a sample 970 in substantially the same manner as described above. The neutral and ionized molecules in the plume 983 from the target portion 971 of the sample 970 can be directed around the sample 970, as shown by arrow 984, first to a mass analyzer 990 and then to a detector 991. The mass-to-charge ratio of the molecules passing through the mass analyzer 990 can be determined by the detector 991. This data can be analyzed to calculate the composition of the molecules.

Figure 9B:
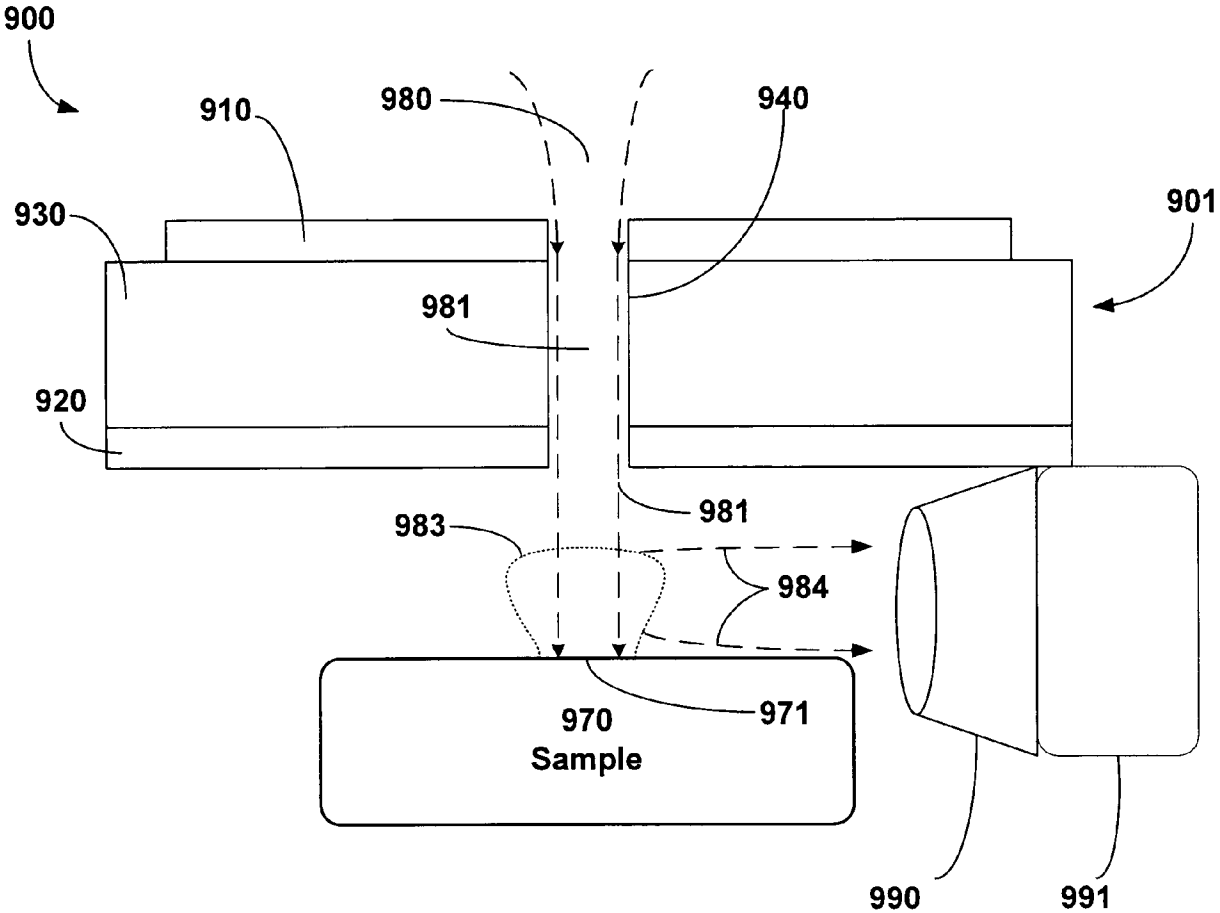
FIG. 9B illustrates an exemplary embodiment of an orthogonal orientation of an imaging mass spectrometry system comprising a microplasma ion source.

In the above described embodiment of the mass spectrometry imaging system 900, the ion source 901 and mass analyzer 990 are arranged substantially inline. In particular, the sample 970 can disposed directly between the ion source 901 and the mass analyzer 990. Various types of samples, however, may not allow for such an arrangement. In other contemplated embodiments, the ion source 910 and the mass analyzer 990 can be oriented orthogonally. FIG. 9B illustrates an exemplary embodiment of an orthogonal orientation of an imaging mass spectrometry system 900 comprising a microplasma ion source 901. In other contemplated embodiments, the ion source 910 and mass analyzer 990 can also be orientated at other angles depending upon the sample and particular implementation of the mass spectrometer 900. For example, the ion source 901 and mass analyzer 990 can both be disposed above the surface of the target portion 971 at 45 degree angles relative to the surface.

The embodiment described above of ion source 901 can incorporate various features of any of previously described embodiments. For example, the ion source 901 can be sealed from the ambient air, incorporating features of the embodiment illustrated in FIG. 6. Further, the ion source 901 can also incorporate a fourth electrode as illustrated in FIG. 5. Additionally, in other embodiments, the ion source 901 can include a third electrode as illustrated in FIG. 4.

Various exemplary embodiments have been disclosed above. It will be apparent to those skilled in the art that many modifications, additions, and deletions, especially in matters of shape, size, and arrangement of parts, can be made therein without substantially departing from the design function of the embodiments described herein. Therefore, other modifications or embodiments as may be suggested by the teachings herein are particularly reserved as they fall within the breadth and scope of the claims here appended.

The invention claimed is:

1. A system for chemically and spatially imaging a sample comprising:

a ion source comprising a first electrode, a second electrode, a dielectric element disposed between the first and second electrodes, and a first aperture traversing the first electrode, second electrode, and dielectric element;

a microfluidic mounting plane for incorporation of the ion-source into a translation scanning stage;

a translation scanning stage for spatial imaging; and a spatial discrimination stage.

2. The system of claim 1, the ion source transforming one or more gases passing through the first aperture into a plasma.

3. The system of claim 2, wherein the one or more gases comprises air, argon, helium and neon.

4. The system of claim 3, wherein the one or more gases further comprise hydrogen to produce high energy vacuum ultraviolet photons.

5. The system of claim 1, further comprising a power source coupled to the first electrode and the second electrode, the power source exciting the first electrode and second electrode to generate a field within the first aperture, the field partially ionizing a gas passing through the aperture to form a plasma.

6. The system of claim 5, wherein the power source is a DC power source, an AC power source, or a pulsed voltage power source.

7. The system of claim 1, further comprising a third electrode disposed parallel to the second electrode, the third electrode having a second aperture concentrically aligned with the first aperture.

8. The system of claim 7, further comprising a fourth electrode disposed parallel to the second electrode and located between the second and third electrodes, the fourth electrode defining a conduit concentrically aligned with the first aperture.

9. The system of claim 7, further comprising an enclosure surrounding a portion of the first electrode, the enclosure receiving the gas and direct the gas into the first aperture, the enclosure securing the first aperture from ambient conditions.

10. The system of claim 9, further comprising a channel disposed between the second and third electrodes, the channel having a first portal and a second portal, the first and second portal concentrically aligned with the first and second apertures, the channel directing a transport gas through a conduit defined by the channel past the first and second portals to the mass analyzer.

11. The system of claim 1, further comprising:

a third electrode disposed parallel to the second electrode, the third electrode having a second aperture concentrically aligned with the first aperture; and a fourth electrode disposed parallel to the second electrode and between the second and third electrodes, the fourth electrode defining a cylindrical conduit concentrically aligned with the first aperture.

12. The system of claim 11, further comprising:

an enclosure surrounding a portion of the first electrode, the enclosure adapted to receiving a gas and directing the gas into the first aperture, the enclosure securing the first aperture from ambient conditions; and a channel disposed between the second and third electrodes, the channel having a first portal and a second portal, the first and second portals concentrically aligned with the first and second apertures, the channel having an inlet for receiving a transport gas, the channel directing the transport gas through a conduit defined by the channel past the first and second portals to an outlet coupled to the mass analyzer.

13. The system of claim 1, wherein the ion-source is a non-thermal plasma.

14. The system of claim 13, wherein the non-thermal plasma ionization occurs under ambient temperature or pressure, or both.

15. The system of claim 13, wherein one or more components of the plasma escape a plasma region of the plasma and ionize at least a portion of the sample.

16. The system of claim 1, further comprising a mass analyzer.

17. The system of claim 1, further comprising a charged particle detector.

18. The system of claim 1, wherein the spatial discrimination stage is a mechanical scanning stage that translates one or more of the sample, the ion source, or a desorption mechanism.

19. The system of claim 1, wherein the spatial discrimination stage is a microscope.

20. The system of claim 1, further comprising an optical imaging stage.

21. The system of claim 1, wherein the ion source ionizes at least a portion of the sample directly.

22. The system of claim 1, wherein the ion source ionizes the sample indirectly.

23. A system for imaging a sample, the system comprising:

an ion source ;

an array comprising:

a plurality of first front electrodes disposed in parallel on a first side of the array;

a plurality of first back electrodes disposed in parallel on a second side of the array;

a dielectric element disposed between the plurality of first front electrodes and first back electrodes; and a plurality of apertures traversing the plurality of first front electrodes first back electrodes and dielectric element;

wherein the plurality of first front electrodes are disposed orthogonally to the plurality of first back electrodes; and a mass analyzer.

24. The system of claim 23, further comprising a device for detecting charged particles.

25. The system of claim 23, further comprising a scanning stage for imaging.

26. The system of claim 25, wherein the scanning stage comprises a microscope for optically locating a target portion of the sample.

27. The system of claim 26, wherein the microscope spatially-resolves image data and the mass analyzer measures mass spectral data simultaneously.

28. The system of claim 23, further comprising a power source coupled to at least one of the plurality of first front electrodes and at least one of the plurality of first back electrodes to generate a non-thermal plasma within at least one of the plurality of apertures.

29. The system of claim 28, wherein the power source is a DC power source, an AC power source, or a pulsed voltage power source.

30. The system of claim 28, further comprising a solenoid for pulsed operation of the ion source.

* * * * *